US005217165A

United States Patent [19]

Takahashi et al.

[11] Patent Number: 5,217,165

[45] Date of Patent: Jun. 8, 1993

[54] ULTRASONIC WAVE NEBULIZER

[75] Inventors: Minoru Takahashi; Makoto Ono, both of Chiba, Japan

[73] Assignee: TDK Corporation, Tokyo, Japan

[21] Appl. No.: 809,876

[22] Filed: Dec. 18, 1991

[30] Foreign Application Priority Data

Dec. 28, 1990 [JP] Japan ..... 2-415428

[51] Int. Cl.[5] ..... B05B 17/06

[52] U.S. Cl. ..... 239/102.2; 261/81; 261/DIG. 48

[58] Field of Search ..... 239/102.2, 102.1; 261/DIG. 48, 81; 128/200.16

[56] References Cited

U.S. PATENT DOCUMENTS 4,031,171 6/1977 Asao et al. ..... 239/102.2
4,087,495 5/1978 Umehara ..... 239/102.2

FOREIGN PATENT DOCUMENTS 0035854 3/1980 Japan ..... 239/102.2
0110843 8/1980 Japan ..... 239/102.2
36386 9/1980 Japan .
0117039 6/1985 Japan ..... 261/DIG. 48

*Primary Examiner*—Andres Kashnikow
*Assistant Examiner*—Karen B. Merritt
*Attorney, Agent, or Firm*—Martin Novack

[57] ABSTRACT

In an ultrasonic wave nebulizer having a piezoelectric vibrator (1) at the bottom of a water container for exciting ultrasonic vibration of water on the water surface to convert water to mist, a flat plate (16) having a center aperture (15) is provided above the vibrator (1) with a spacing (Z) between the plate (16) and the vibrator (1), so that the aperture (15) is positioned above the center of the vibrator (1). The plate (16) has no further apertures except the center aperture (15). The diameter (D) of the aperture (15) is smaller than the diameter (A) of the vibrator (1). The presence of the aperture (15) above the vibrator (1) improves the performance of the nebulizer, and increases the generation of mist.

11 Claims, 7 Drawing Sheets

ULTRASONIC WAVE NEBULIZER

BACKGROUND OF THE INVENTION

The present invention relates to a nebulizer, or an ultrasonic wave mist generator and in particular, relates to such an apparatus which has a piezoelectric vibrator at the bottom of a water container for converting liquid water to mist.

In an ultrasonic nebulizer, the water surface is violently vibrated with ultrasonic wave frequency by a piezoelectric vibrator which is mounted at the bottom of the water, and water at the water surface is converted to mist. In order to obtain high performance of conversion, the energy by the vibrator must be concentrated on a small active area of the water surface. The water vibration at the peripheral region of the water surface would interfere with the vibration at the active area, and would decrease the conversion efficiency.

Conventionally, JP patent publication 36386/1980 has been known for improving efficiency for atomization. That publication describes a plate or a gate which is located between a piezoelectric vibrator and the water surface, and said plate has a first large aperture for passing the main lobe of vibration, and a plurality of second small peripheral apertures for passing side lobes of vibration. It is theorized that the second apertures function such that side lobes of vibration are diffracted, and are cancelled by each other, and so do not disturb the main lobe vibration. Therefore, the conversion efficiency from water to mist is improved.

However, the efficiency of atomization by said plate is only 5-7%.

Another prior art reference is JP patent laid open publication 23738/1985, in which a porous member is mounted in a water container except the center portion just above a vibrator. The porous member absorbs the undesired side lobe vibration at the periphery of the water surface.

However, it has the disadvantages that the efficiency improvement is still small, and the presence of a porous member causes some trouble in cleaning the water container.

SUMMARY OF THE INVENTION

It is an object, therefore, of the present invention to overcome the disadvantages and limitations of a prior nebulizer or an atomizer by providing a novel and improved nebulizer.

It is also an object of the present invention to provide a nebulizer which improves the efficiency of atomization and provides more mist.

The above and other objects are attained by an ultrasonic wave nebulizer comprising a water container, and a piezoelectric vibrator element of mounted at the bottom of said water container so that said vibrator element contacts water, and ultrasonic energy generated by said vibrator element converts water to mist; a flat plate having a center aperture being provided above said vibrator element with a predetermined spacing between said plate and said vibrator element, the diameter of said aperture being smaller than the diameter of said vibrator element, and said plate having to further aperture except said center aperture.

BRIEF DESCRIPTION OF THE DRAWINGS

The foregoing and other objects, features, and attendant advantages of the invention will be appreciated as the same become better understood by means of the following description and accompanying drawings wherein.

DESCRIPTION OF THE PREFERRED EMBODIMENTS

Figure 1A:
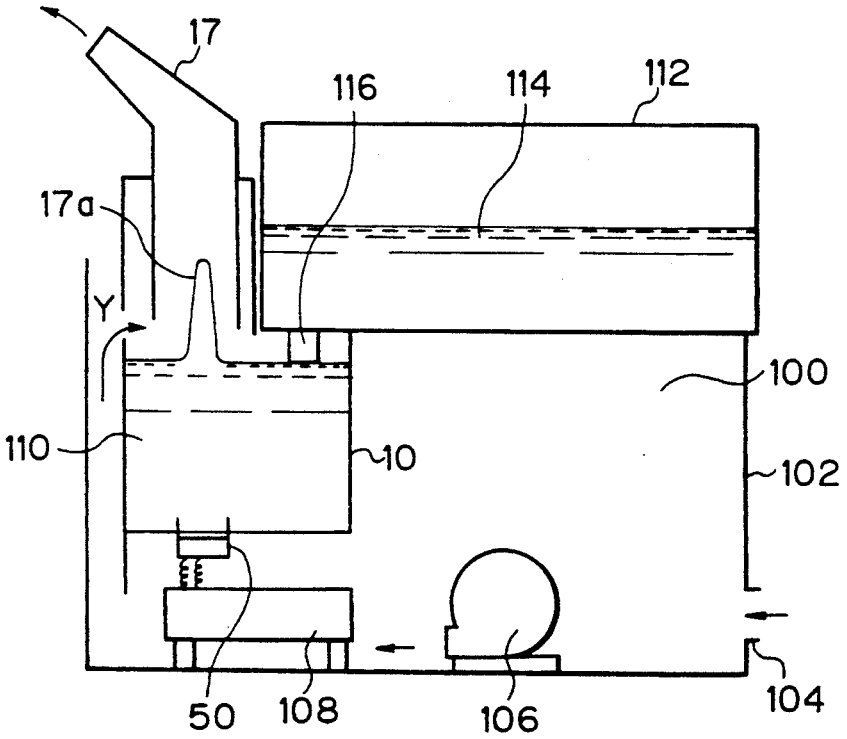
FIG. 1A shows a cross section of a nebulizer according to the present invention.

FIG. 1A shows the structure of the ultrasonic wave nebulizer in which the present invention is applied. In the figure, the nebulizer 100 for converting water to mist has a housing 102, on which a water tank 112 is mounted. The water tank 112 which includes water 114 has a bottom tap 116, which is closed when the water tank is removed, and is open when the water tank is placed on the housing 102 which has a projection (not shown) through the tap 116. The water container 10 which includes water 110 is fixed to the housing 102, and is supplied water from the water tank 112 through the tap 116 so that the water level in the container 10 is almost constant.

A vibrator unit 50 for vibrating water is fixed at the bottom of the water container 10. That vibrator unit 50 is excited by an electronic circuit 108 which is fixed to the housing 102. When the vibrator unit 50 vibrates water, water column 17*a* is generated on the surface of water 110, and the water in the column 17*a* is converted to fine mist, which is output through a hollow cylindrical member 17 into an air.

A fan 106 is provided in the housing 102 so that there is air circulation from an air inlet 104, through the electronic circuit 108 and the arrow Y, to the cylindrical member 17. That air circulation functions to output the generated mist into a room, and to cool the electronic circuit 108, and the vibration unit 50.

The present invention concerns the improvement of the vibration unit 50, which is described in detail below.

Figure 1B:
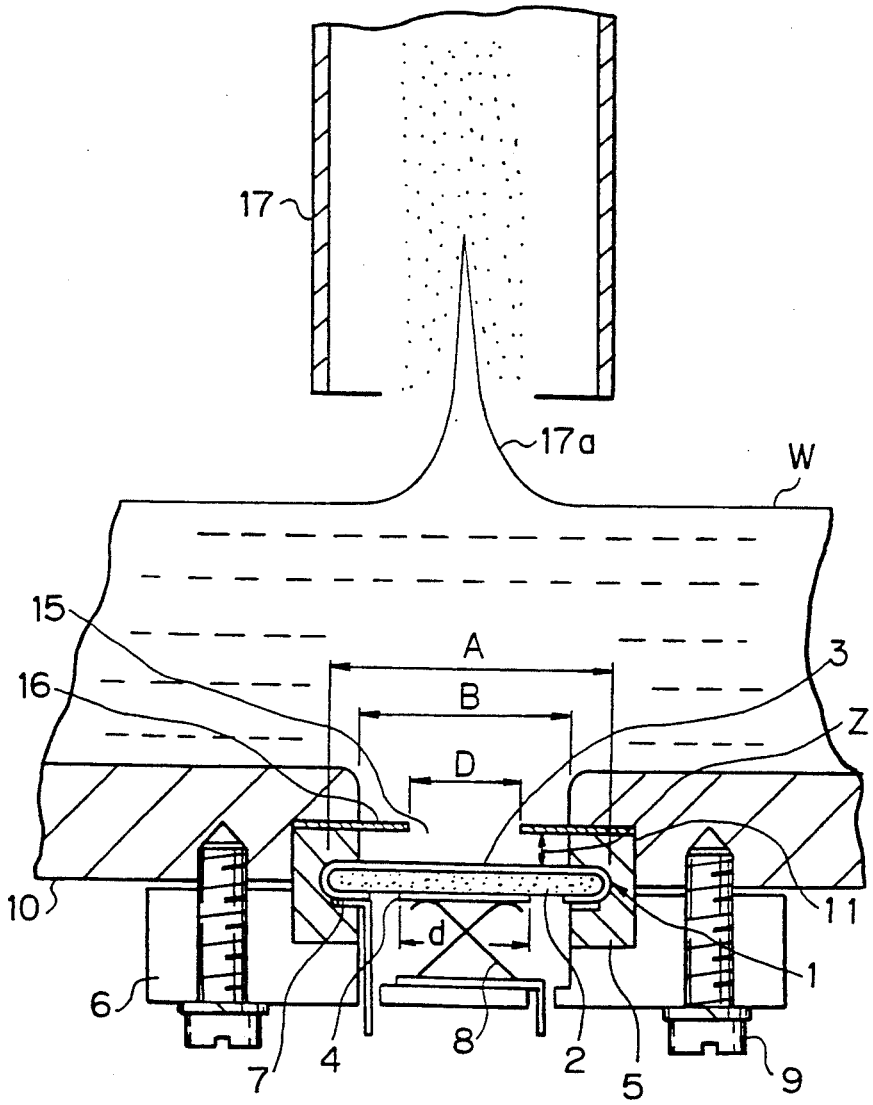
FIG. 1B shows the main portion of the nebulizer according to the present invention.

FIG. 1B shows structure of a vibrator unit 50 according to the present invention. In the figure, the numeral 1 is a piezoelectric vibrator element having a piezoelectric ceramics substrate 2, a first electrode 3, and a second electrode 4. The first electrode 3 covers the upper surface of the ceramics substrate 2 and contacts with water. The first electrode 3 is offset at the edge of the substrate 2 and remains a ring-shaped portion at the periphery on the rear surface of the substrate 2. The second electrode 4 is attached at the center of the rear surface of the substrate 2. Those electrodes 3 and 4 are attached on the surfaces of the substrate 2, and upon applying alternate power between those electrodes, the ceramics 2 is excited to generate ultrasonic to atomize water. The vibrator element 1 is held by a resilient holder 5 which has a ring shaped groove for accepting the vibrator element 1. The holder 5 itself is fixed to a case 6. A ring shaped electrode 7 is provided so that the electrode 7 contacts with the periphery of the first electrode 3 which is attached on the vibrator element at the bottom of the element 1. A spring electrode 8 contacts with the second electrode 4. Preferably, the second electrode 4 at the bottom of the vibrator element is circular, and the diameter (d) of the second electrode 4 is smaller than the diameter A of the vibrator element 1 itself. Preferably, the diameter (d) of the second electrode 4 is smaller than the diameter B of the portion that the vibrator 1 contacts with water. The electrodes 7 and 8 are coupled with a high frequency power generator (108 in FIG. 1A) which excites the vibrator element 1. The case 6 is fixed to the water container 10 which contains water W, and has a bottom hole so that the vibrator element 1 is positioned in said bottom hole. The case 6 is fixed to said water container 10 by screws 9. A circular flat plate 16 which has a circular center aperture 15 is provided between the holder 5 and the water container 10. The plate 16 is made of silicon gum, and doubles as a water seal packing.

The plate 16 is ring-shaped, and the plate 16 has no aperture except the center aperture 15. The numeral 17 is a mist cylinder fixed to the container, and functions to output atomized mist with air-flow.

The vibrator element 1 is excited with the high frequency power supply with the frequency close to the resonant frequency of the vibrator element 1, and the vibration of the vibrator element 1 generates ultrasonic wave energy into water. The ultrasonic wave energy has a main lobe, and side lobes, among them a main lobe energy passes the aperture 15 of the plate 16, and generates water column 17*a* on water surface, and said water column 17*a* provides atomized mist. The side lobes generated by the vibrator are prevented by the plate 16, and so do not reach the water surface. Therefore, the main lobe vibration at the water surface is not disturbed.

Figure 2:
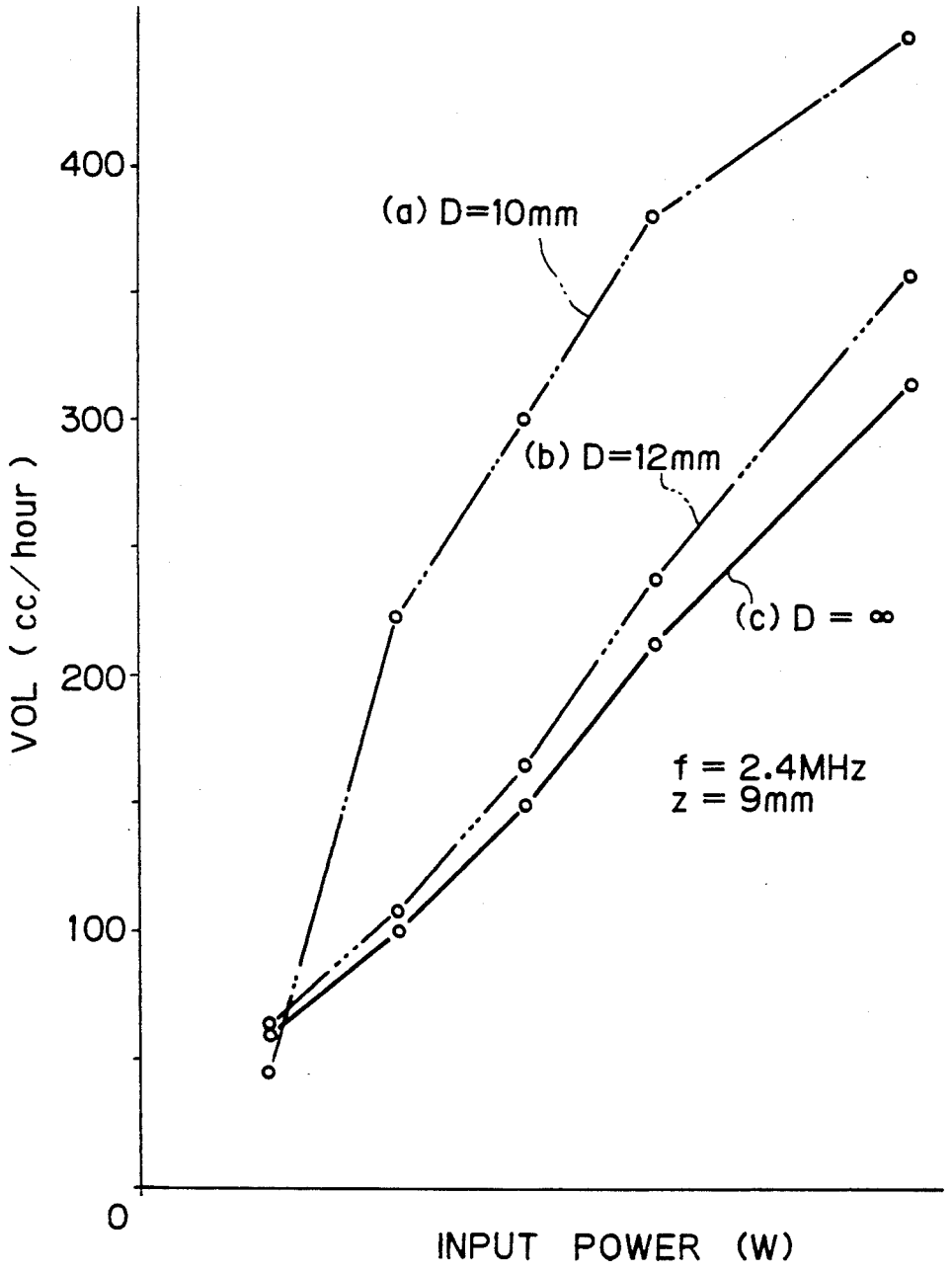
FIG. 2 shows experimental curves of the present nebulizer.

FIG. 2 shows experimental curves between input power to the vibrator element 1 and the amount of the generated mist with the parameter of the diameter of the aperture 15. In the figure, the horizontal axis shows input power in watts, and the vertical axis shows the generated mist in cc/hour. The curve (a) shows the case that the diameter D of the aperture 15 is 10 mm, the curve (b) shows the case that the diameter D of the aperture 15 is 12 mm, and the curve (c) shows the case that no plate 16 is provided (prior art) for the sake of comparison. The experimental conditions in those curves are that the diameter A of the vibrator element 1 is 20 mm, the diameter B of the portion of the vibrator element 1 contacting water is 18 mm, the frequency of input power to the vibrator element 1 is 2.4 MHz, the liquid is water, the length Z between the plate 16 and the upper surface of the vibrator element 1 is 9 mm, the material of the plate 16 is silicon gum, and the diameter (d) of the second electrode 4 is 10 mm.

Figure 3:
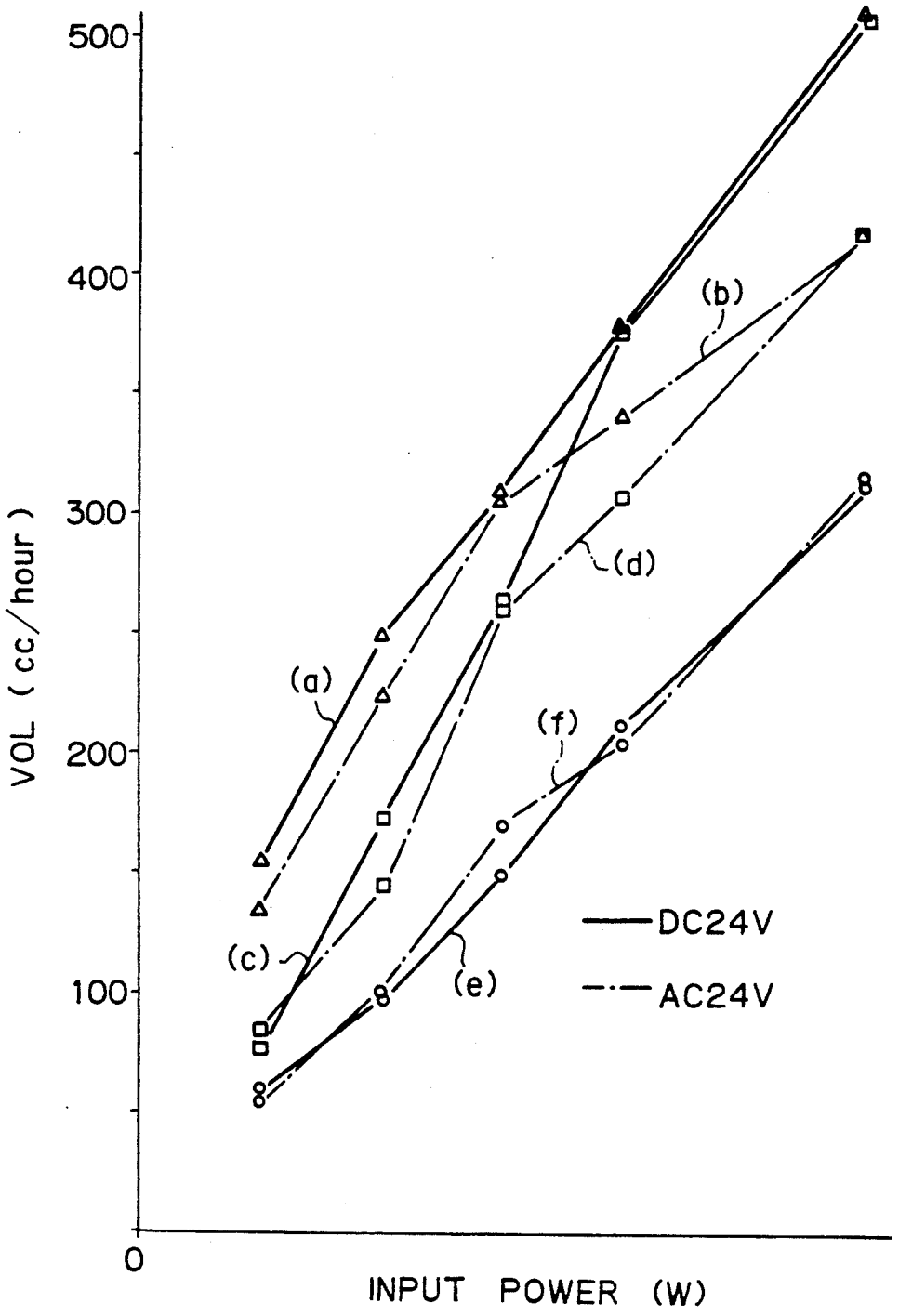
FIG. 3 shows other experimental curves of the present nebulizer.

FIG. 3 shows other experimental curves between the input power and the amount of the generated mist with the parameter of the material of the plate 16. The horizontal axis shows the input power in watts and the vertical axis shows the amount of the generated mist in cc/hour. The curve (a) shows the case that the plate 16 is made of silicon gum, the diameter of the aperture 15 is 10 mm, and the supply power for high frequency power is DC 24 volts. The curve (b) shows the case that the plate 16 is made of silicon gum, the diameter of the aperture 15 is 10 mm, and the supply power is AC 24 volts. The curve (c) shows the case that the plate 16 is made of stainless steel sheet, the diameter of the aperture 15 is 10 mm, and the supply power is DC 24 volts. The curve (d) shows the case that the plate 16 is made of stainless steel sheet, the diameter of the aperture 15 is 10 mm, and the supply power is AC 24 volts. The curve (e) shows the case that no plate 16 is used, and the supply power is DC 24 volts, and the curve (f) shows the case that no plate 16 is used, and the supply power is AC 24 volts. In those curves, the liquid is water, and the length Z is 9 mm.

It should be appreciated in FIGS. 2 and 3 that the amount of mist is two or three times as much as the case that no plate 16 is used when supply power is small, and said amount of mist is 1.5 times as much as that of the case with no aperture 15 even when input power is relativey large.

Therefore, it should be appreciated that the presence of the plate 16 with the center aperture 15 improves the efficiency of a nebulizer to generate more mist.

Figure 4:
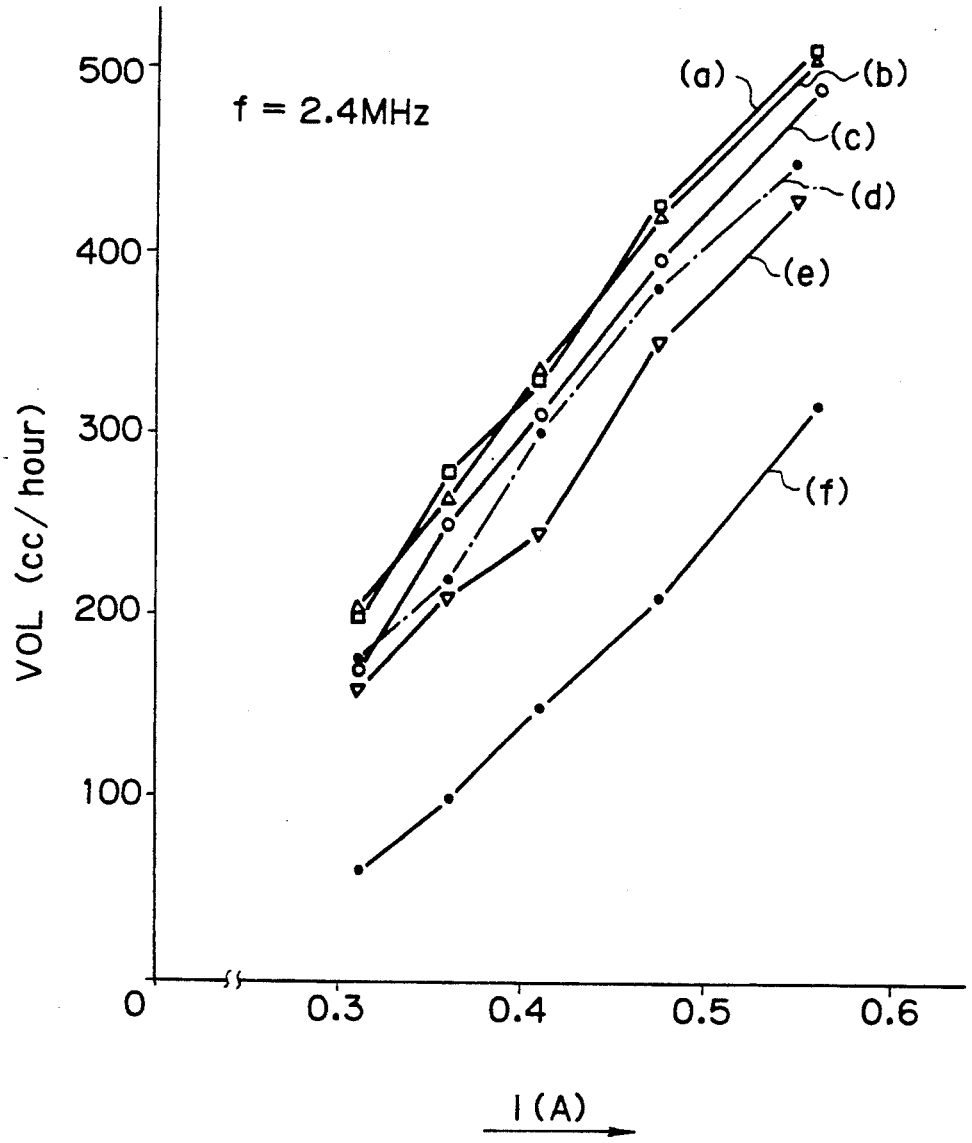
FIG. 4 shows still other experimental curves of the present nebulizer.

FIG. 4 shows other experimental curves, in which the horizontal axis shows input current in Ampere, and the vertical axis shows the generated mist in cc/hour. The exciting frequency in those curves is 2.4 MHz, and the diameter D of the aperture 15 is 10 mm. The parameter in FIG. 4 is the length Z between the vibrator and the aperture. The curve (a) shows the case the length Z is 7.5 mm, the curve (b) shows the case that the length Z is 5.0 mm, the curve (c) shows the case that Z is 2.5 mm, the curve (d) shows the case of $Z=0$, the curve (e) shows the case of $Z=10$ mm, and the curve (f) shows the case that no plate and no aperture is provided.

Figure 5:
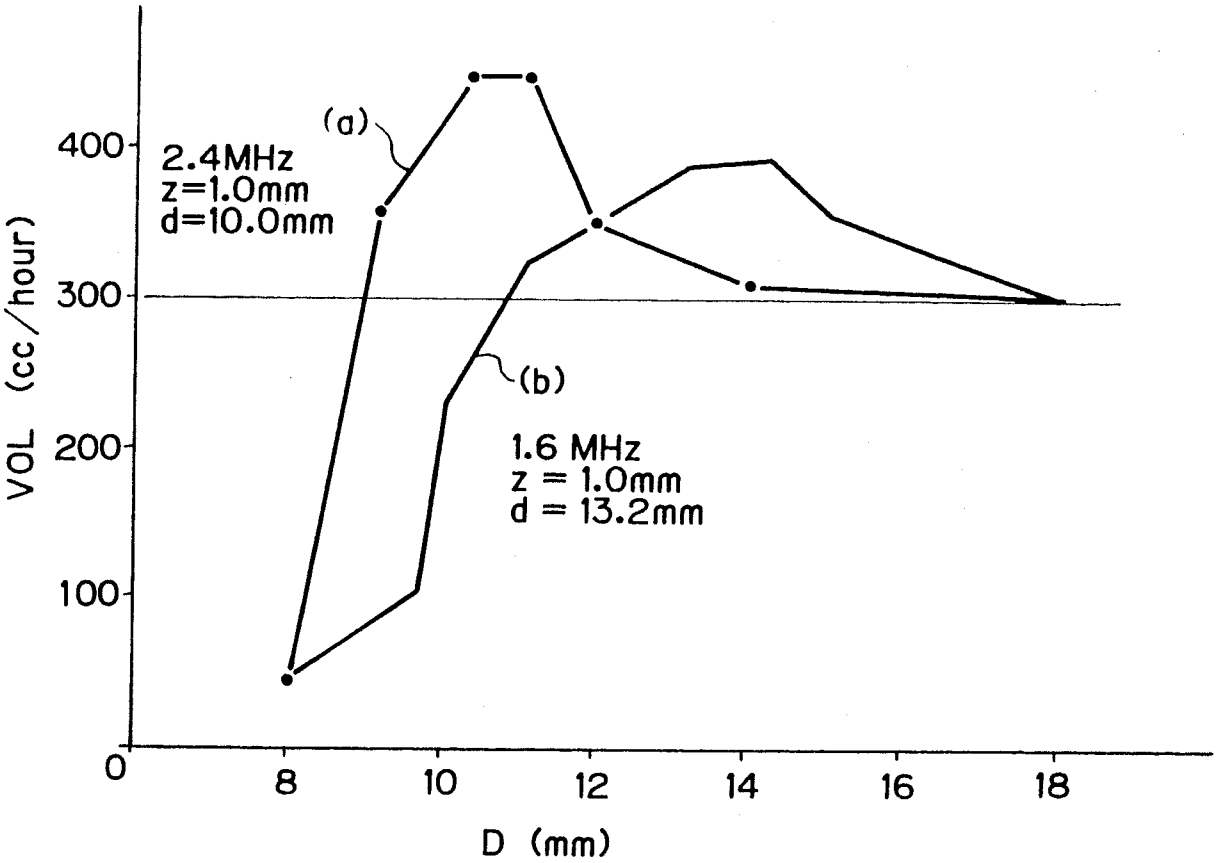
FIG. 5 shows still other experimental curves of the present nebulizer.

FIG. 5 shows still other experimental curves, in which the horizontal axis shows the diameter D (mm) of the aperture 15, and the vertical axis shows the generated mist in cc/hour.

The curve (a) shows the case that the exciting frequency is 2.4 MHz, the length Z between the vibrator and the aperture is 1.0 mm, and the diameter (d) of the rear electrode 4 on the vibrator is 10 mm. The curve (b) shows the case that the exciting frequency is 1.6 MHz, the length Z is 1.0 mm, and the diameter (d) is 13.2 mm.

The curves (a) and (b) show that when the diameter D of the aperture becomes large, the generation of the mist converges to 300 cc/hour, and when the diameter D is around 10 mm (curve a), or the diameter D is around 13 mm (curve b), the generation of the mist is higher than 1.3 times as much as that when no aperture is provided.

We draw conclusion that when the diameter D is around the same as the diameter (d) of the rear electrode, the generation of the mist is improved the most. The preferable range of the diameter D of the aperture is around 0.85 d–1.15 d.

The preferable value of Z is less than 10.0 mm from FIGS. 4 and 5.

Figure 6:
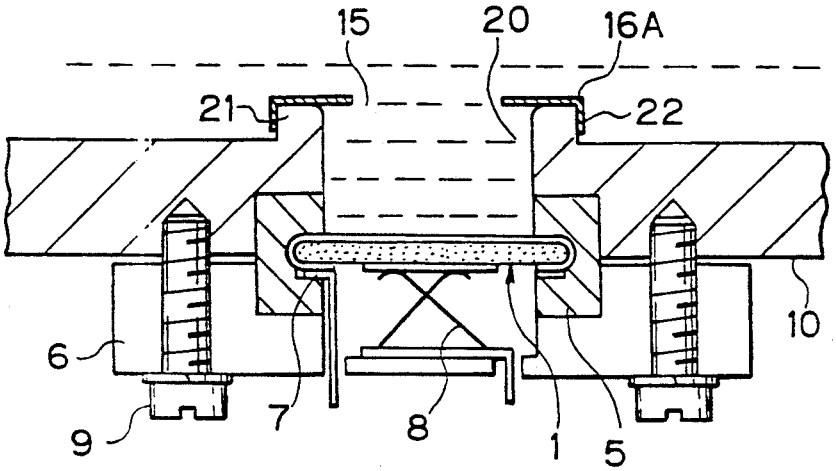
FIG. 6 shows structure of another embodiment of the present nebulizer.

FIG. 6 shows the structure of another embodiment of the present invention. In this embodiment, a ring-shaped projection 21 is provided around the hole 20 of the water container so that said projection 21 is integral with the water container. The plate 16A which has the aperture 15 covers said projection 21, by being engaged with outer wall of the projection 21. The plate 16A has a vertical side ring 22 which provides a snap-fix to the projection 21. The advantage of the embodiment of FIG. 6 is that the plate 16A is removable.

Figure 7:
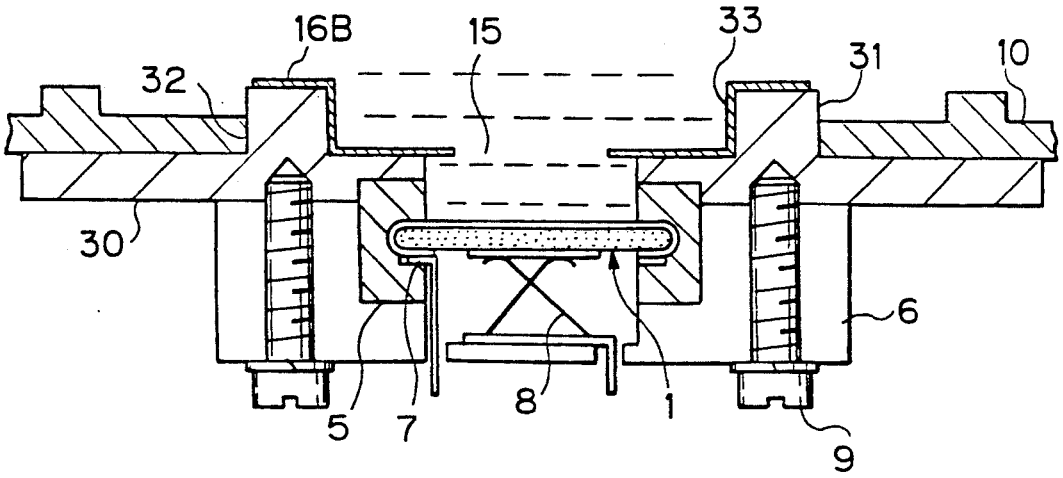
FIG. 7 shows structure of still another embodiment of the present nebulizer.

FIG. 7 shows still another embodiment of the present nebulizer. In the figure, the case 6 which keeps the vibration element 1, the resilient holder 5, and the electrodes 7 and 8, is fixed to the chamber base 30 by using the screws 9. The chamber base 30 has a ring-shaped projection 31 which is engaged with the bottom hole 32 of the water container which contains water. The chamber base, 30 itself is fixed to the water container in water-proof fashion. The ring-shaped projection 31 on the chamber base 30 is covered with the ring-shaped plate 16B, which has a side vertical ring 33. The plate 16B is removable, and the vertical ring 33 conforms with the inner surface of the ring-shaped projection 31.

In the embodiments of FIGS. 6 and 7, it should be noted that the plates 16A and 16B are removable, and therefore, it is easy to clean the vibration element by removing the plate.

It should be appreciated that the aperture 15 is not restricted to be circular, but a triangular aperture or rectangular aperture, or polygonal aperture is possible in the present invention. Further, when the thickness of the plate 16, 16A or 16B is thick, the plate can double as a mist cylinder 17.

As mentioned above, according to the present nebulizer, a plate having an aperture which is smaller than a vibration element is provided on the vibration element with some distance from the vibration element. The presence of that plate improves the efficiency of mist conversion, and increases the amount of the generated mist. Further, if the plate is made of disinfectant material, the water is kept fresh.

From the foregoing, it will now been apparent that a new and improved nebulizer has been discovered. It should be understood of course that the embodiments disclosed are merely illustrative and are not intended to limit the scope of the invention. Reference should be made to the appended claims, therefore, rather than the specification as indicating the scope of the invention.

What is claimed is:

1. An ultrasonic wave nebulizer, comprising:

a water container, and a piezoelectric vibrator element mounted at the bottom of said water container so that said vibrator element contacts water and ultrasonic energy generated by said vibrator element converts water to mist, characterized in that:

a flat plate having a single center aperture is provided above said vibrator element with a predetermined spacing between said plate and said vibrator element, the diameter of said aperture is smaller than the diameter of said vibrator element, and said vibrator element is coupled with said water container through a resilient holder that is discrete from said flat plate.

2. An ultrasonic wave nebulizer according to claim 1, wherein said flat plate is provided between said resilient holder and said water container, and said flat plate doubles as a water-seal packing.

3. An ultrasonic wave nebulizer according to claim 1, wherein said water container has a ring-shaped projection (21, 31), and said plate (16) is removably engaged with said projection (21, 31).

4. An ultrasonic wave nebulizer according to claim 3, wherein said plate (16) has a vertical side ring (22) which engages with an outer wall of said projection (21).

5. An ultrasonic wave nebulizer according to claim 3, wherein said plate (16) has a vertical side ring (33) which engages with an inner wall of said projection (31).

6. An ultrasonic wave nebulizer according to claim 1, wherein said vibrator element has a pair of electrodes for exciting the vibrator element, a first electrode is attached on an upper surface of the vibrator element, a second electrode is attached on a lower surface of the vibrator element and the diameter of the second electrode is smaller than the diameter of the vibrator element, and the diameter of the aperture is about the same as the diameter of the second electrode.

7. An ultrasonic wave nebulizer according to claim 6, wherein the diameter of the aperture is in the range between 0.85 d and 1.15 d, where d is the diameter of the second electrode.

8. An ultrasonic wave nebulizer according to claim 1, wherein the spacing between the aperture and the vibrator element is less than 10.0 mm.

9. An ultrasonic wave nebulizer, comprising:

a water container, and a piezoelectric vibrator element mounted at the bottom of said water container so that said vibrator element contacts water and ultrasonic energy generated by said vibrator element converts water to mist, characterized in that:

a flat plate having a single center aperture is provided above said vibrator element with a predetermined spacing between said plate and said vibrator element, the diameter of said aperture is smaller than the diameter of said vibrator element, and said water container has a ring-shaped projection (21, 31), and said plate (16) is removably engaged with said projection (21, 31).

10. An ultrasonic wave nebulizer according to claim 9, wherein said plate (16) has a vertical side ring (22) which engages with an outer wall of said projection (21).

11. An ultrasonic wave nebulizer according to claim 9, wherein said plate (16) has a vertical side ring (33) which engages with an inner wall of said projection (31).

* * * * *